US009140429B2

(12) United States Patent
Pickard

(10) Patent No.: US 9,140,429 B2
(45) Date of Patent: Sep. 22, 2015

(54) OPTICAL ELEMENT EDGE TREATMENT FOR LIGHTING DEVICE

(75) Inventor: Paul Kenneth Pickard, Morrisville, NC (US)

(73) Assignee: CREE, INC., Durham, NC (US)

( * ) Notice: Subject to any disclaimer, the term of this patent is extended or adjusted under 35 U.S.C. 154(b) by 199 days.

(21) Appl. No.: 12/905,054

(22) Filed: Oct. 14, 2010

(65) Prior Publication Data

US 2012/0092850 A1 Apr. 19, 2012

(51) Int. Cl.

| | |
|---|---|
| ***F21V 9/16*** | (2006.01) |
| ***F21V 13/00*** | (2006.01) |
| ***F21K 99/00*** | (2010.01) |
| *F21V 13/02* | (2006.01) |
| *F21Y 101/02* | (2006.01) |
| *F21V 7/22* | (2006.01) |

(52) U.S. Cl.

CPC . *F21V 13/00* (2013.01); *F21K 9/56* (2013.01); *F21V 9/16* (2013.01); *F21K 9/135* (2013.01); *F21V 7/22* (2013.01); *F21V 13/02* (2013.01); *F21Y 2101/02* (2013.01)

(58) Field of Classification Search

CPC ..... F21K 9/135; F21K 9/56; F21V 13/00
USPC ..... 362/249.02, 311.02, 800, 84, 231, 235; 257/98, 99

See application file for complete search history.

(56) References Cited

U.S. PATENT DOCUMENTS

| | | | |
|---|---|---|---|
| 5,959,316 | A | 9/1999 | Lowery |
| 6,350,041 | B1 | 2/2002 | Tarsa et al. |
| 7,005,679 | B2 | 2/2006 | Tarsa et al. |
| 7,029,935 | B2 | 4/2006 | Negley et al. |
| 7,042,020 | B2 | 5/2006 | Negley |
| 7,070,300 | B2 | 7/2006 | Harbers et al. |

(Continued)

FOREIGN PATENT DOCUMENTS

| | | | |
|---|---|---|---|
| CA | 2704991 | A1 | 6/2009 |
| CN | 101611500 | A | 12/2009 |

(Continued)

OTHER PUBLICATIONS

International Search Report for International Patent Application No. PCT/US2011/054146 dated Apr. 18, 2012.

(Continued)

*Primary Examiner* — Anh Mai
*Assistant Examiner* — Jessica M Apenteng
(74) *Attorney, Agent, or Firm* — Withrow & Terranova, P.L.L.C.; Vincent K. Gustafson

(57) ABSTRACT

A lighting device includes an electrically activated emitter, a lumiphoric material spatially segregated from the emitter, and an optical element arranged between the emitter and the lumiphoric material and having at least one peripheral edge, wherein a reflective material is disposed proximate to the at least one peripheral edge and/or wherein the at least one peripheral edge is non-perpendicular to a face of the optical element and arranged to reflect light in a direction toward the lumiphoric material. An optical element for use with a lighting device including a lumiphoric material includes a peripheral edge, wherein a reflective material disposed substantially parallel to the peripheral edge and/or wherein the peripheral edge is non-perpendicular to a face of the optical element and arranged to reflect light in a direction toward the lumiphoric material.

28 Claims, 3 Drawing Sheets

(56) References Cited

U.S. PATENT DOCUMENTS

| | | | | |
|---|---|---|---|---|
| 7,456,499 | B2 | 11/2008 | Loh et al. | |
| 7,564,180 | B2 | 7/2009 | Brandes | |
| 7,614,759 | B2 | 11/2009 | Negley | |
| 7,663,152 | B2 * | 2/2010 | Bierhuizen et al. | 257/98 |
| 7,791,092 | B2 | 9/2010 | Tarsa et al. | |
| 7,799,586 | B2 | 9/2010 | Leung et al. | |
| 7,800,287 | B2 | 9/2010 | Zheng et al. | |
| 8,491,140 | B2 | 7/2013 | Van De Ven et al. | |
| 2002/0185966 | A1 | 12/2002 | Murano | |
| 2004/0145895 | A1 | 7/2004 | Ouderkirk et al. | |
| 2004/0218387 | A1 | 11/2004 | Gerlach | |
| 2005/0093430 | A1 | 5/2005 | Ibbetson et al. | |
| 2005/0265029 | A1 * | 12/2005 | Epstein et al. | 362/339 |
| 2005/0270775 | A1 | 12/2005 | Harbers et al. | |
| 2006/0171152 | A1 | 8/2006 | Suehiro et al. | |
| 2007/0085103 | A1 | 4/2007 | Nishioka et al. | |
| 2007/0170447 | A1 | 7/2007 | Negley et al. | |
| 2007/0223219 | A1 | 9/2007 | Medendorp, Jr. et al. | |
| 2007/0240346 | A1 | 10/2007 | Li et al. | |
| 2008/0029720 | A1 | 2/2008 | Li | |
| 2008/0117500 | A1 | 5/2008 | Narendran et al. | |
| 2008/0192458 | A1 | 8/2008 | Li | |
| 2008/0211386 | A1 | 9/2008 | Choi et al. | |
| 2008/0218992 | A1 | 9/2008 | Li | |
| 2008/0218993 | A1 | 9/2008 | Li | |
| 2009/0008573 | A1 * | 1/2009 | Conner | 250/459.1 |
| 2009/0050908 | A1 | 2/2009 | Yuan et al. | |
| 2009/0052158 | A1 * | 2/2009 | Bierhuizen et al. | 362/84 |
| 2009/0250710 | A1 | 10/2009 | Negley | |
| 2009/0250714 | A1 | 10/2009 | Yun et al. | |
| 2009/0295265 | A1 | 12/2009 | Tabuchi et al. | |
| 2010/0027293 | A1 | 2/2010 | Li | |
| 2010/0164346 | A1 | 7/2010 | Li et al. | |
| 2010/0177509 | A1 | 7/2010 | Pickard | |
| 2010/0277907 | A1 | 11/2010 | Phipps et al. | |
| 2012/0092850 | A1 | 4/2012 | Pickard | |
| 2013/0229786 | A1 | 9/2013 | Pickard et al. | |

FOREIGN PATENT DOCUMENTS

| | | | |
|---|---|---|---|
| GB | 2366610 | A | 3/2002 |
| JP | 2006032726 | A | 2/2006 |
| JP | 2007035885 | A | 8/2007 |
| JP | 2008-47539 | A | 2/2008 |
| JP | 2008-53702 | A | 3/2008 |
| JP | 2010-21497 | A | 1/2010 |
| JP | 2010-510654 | A | 4/2010 |
| JP | 2010141171 | A | 6/2010 |
| WO | WO 2008/060335 | A1 | 5/2008 |
| WO | WO 2010/044239 | A1 | 4/2010 |

OTHER PUBLICATIONS

Co-pending U.S. Appl. No. 12/941,012, filed Nov. 5, 2010.

Co-pending U.S. Appl. No. 12/941,014, filed Nov. 5, 2010.

Extended European Search Report for European Patent Application No. 11833122.2, mailed Jul. 9, 2014, 10 pages.

Non-final Office Action for U.S. Appl. No. 13/864,490, mailed Dec. 19, 2013, 8 pages.

Final Office Action for U.S. Appl. No. 13/864,490, mailed Mar. 28, 2014, 10 pages.

Advisory Action for U.S. Appl. No. 13/864,490, mailed Jun. 6, 2014, 3 pages.

Notice of Reasons for Rejection for Japanese Patent Application 2013-533874, mailed Nov. 27, 2014, 6 pages.

Official Action corresponding to Japanese Patent Application No. 2013-533874 dated Mar. 11, 2014.

Notification of the First Office Action for Chinese Patent Application No. 2011800498647, issued Feb. 28, 2015, 15 pages.

Office Action for Japanese Patent Application No. 2013-533874, mailed Jun. 12, 2015, 7 pages.

Non-Final Office Action for U.S. Appl. No. 13/864,490, mailed Jul. 2, 2015, 12 pages.

* cited by examiner

OPTICAL ELEMENT EDGE TREATMENT FOR LIGHTING DEVICE

TECHNICAL FIELD

The present invention relates to high output lighting devices, and optical elements therefor, for reducing total internal reflectivity and loss of light.

BACKGROUND

Lumiphoric materials are commonly used with electrically activated emitters to produce a variety of emissions such as colored (e.g., non-white) or white light (e.g., perceived as being white or near-white). Such emitters may include any device capable of producing visible or near visible (e.g., from infrared to ultraviolet) wavelength radiation including, but not limited to, xenon lamps, mercury lamps, sodium lamps, incandescent lamps, and solid state emitters—including light emitting diodes (LEDs), organic light emitting diodes (OLEDs), and lasers. Such emitters may have associated filters that alter the color of the light and/or include lumiphoric materials that absorb a portion of a first peak wavelength emitted by the emitter and re-emit the light at a second peak wavelength different from the first peak wavelength. Phosphors, scintillators, and lumiphoric inks are common lumiphoric materials.

LEDs are solid state electrically activated emitters that convert electric energy to light, and generally include one or more active layers of semiconductor material sandwiched between oppositely doped layers. When bias is applied across doped layers, holes and electrons are injected into one or more active layers, where they recombine to generate light that is emitted from the device. Laser diodes are solid state emitters that operate according to similar principles.

Solid state emitters may be utilized to provide colored or white light. White LED emitters have been investigated as potential replacements for white incandescent lamps. A representative example of a white LED lamp includes a package of a blue LED chip (e.g., made of InGaN and/or GaN) combined with a lumiphoric material such as a phosphor (typically YAG:Ce) that absorbs at least a portion of the blue light (first wavelength) and re-emits yellow light (second wavelength), with the combined yellow and blue emissions providing light that is perceived as white or near-white in character. If the combined yellow and blue light is perceived as yellow or green, it can be referred to as 'blue shifted yellow' ("BSY") light or 'blue shifted green' ("BSG") light. Addition of red spectral output from an emitter or lumiphoric material may be used to increase the warmth of the aggregated light output. As an alternative to phosphor-based white LEDs, combined emission of red, blue, and green emitters and/or lumiphoric materials may also be perceived as white or near-white in character. Another approach for producing white light is to stimulate phosphors or dyes of multiple colors with a violet or ultraviolet LED source.

Many modern lighting applications require high power emitters to provide a desired level of brightness. High power emitters can draw large currents, thereby generating significant amounts of heat. Conventional binding media used to deposit lumiphoric materials such as phosphors onto emitter surfaces typically degrade and change (e.g., darken) in color with exposure to intense heat. Degradation of the medium binding a phosphor to an emitter surface shortens the life of the emitter structure. When the binding medium darkens as a result of intense heat, the change in color has the potential to alter its light transmission characteristics, thereby resulting in a non-optimal emission spectrum. Limitations associated with binding a phosphor to an emitter surface generally restrict the total amount of radiance that can be applied to a phosphor.

In order to increase reliability and prolong useful service life of a lighting device including a lumiphoric material, the lumiphoric material may be physically separated from an electrically activated emitter. Separation of the phosphor element permits the electrically activated emitter to be driven with higher current and thereby produce a higher radiance. Structures that separate phosphors from electrically activated emitters create additional problems, however, including (but not limited to) a reduction in total emission resulting from loss of light through the edges of such structures and/or misguided reflection (e.g., total internal reflection ("TIR")) internal to the structure—such as back upon the electrically activated emitter. Leakage of emissions from an electrically activated emitter past a phosphor can also reduce color uniformity and color rendering. For example, leakage of blue LED emissions past a spatially segregated yellow phosphor can cause aggregate emissions from the device to be perceived (in at least certain directions) as blue shifted yellow or blue shifted green rather than predominately white in character. Any decrease in the amount of light received by the phosphor or other lumiphoric material results in a reduction in light available for upconversion.

U.S. Pat. No. 7,070,300 to Harbers et al. ("Harbers") discloses a phosphor layer that is physically separated from a light source, permitting the light source to be driven with an increased current to produce a higher radiance. Harbers discloses (e.g., in conjunction with FIG. 1 thereof) a LED and phosphor element oriented at ninety degrees with respect to each other, wherein the phosphor element in one embodiment is separated along the beam path by, e.g., air, gas, or a vacuum, at a length of greater than 1 mm from the LED. Similarly, various elements are represented by Harbers (e.g., in conjunction with FIG. 13 thereof) as being separated from one another, e.g., by an air gap. Such separation of elements and gaps create areas prone to leakage of emissions.

In consequence, the art continues to seek improvements in light emitting structures that include many of the advantages associated with use of remote lumiphoric materials (e.g., minimizing heat degradation), but also limit total internal reflectivity and loss of light that tend to reduce emissions and/or affect perception of output color.

SUMMARY

The present invention relates in various embodiments to lighting devices comprising lumiphoric materials spatially segregated from electrically activated emitters, with structures arranged to reduce total internal reflectivity and loss of light.

In one aspect, the invention relates to a lighting device comprising: at least one electrically activated emitter; at least one lumiphoric material spatially segregated from the at least one electrically activated emitter, and arranged to receive at least a portion of emissions from the at least one electrically activated emitter; and an optical element, selected from the group consisting of optical filters and optical reflectors, arranged between the at least one electrically activated emitter and the at least one lumiphoric material, wherein the optical element has at least one peripheral edge; further comprising at least one of the following features (i) and (ii): (i) a reflective material is disposed proximate to the at least one peripheral edge, and (ii) the at least one peripheral edge is non-perpendicular to a face of the optical element and arranged to reflect light in a direction toward the at least one lumiphoric material.

In another aspect, the invention relates to an optical element for use with a lighting device including at least one lumiphoric material, the optical element comprising: at least one of an optical filter and an optical reflector, including at least one peripheral edge and including at least one of the following features (i) and (ii): (i) a reflective material is disposed substantially parallel to the at least one peripheral edge, and (ii) the at least one peripheral edge is non-perpendicular to a face of the optical element and arranged to reflect light in a direction toward the at least one lumiphoric material.

In another aspect, any of the foregoing aspects and/or other features and embodiments disclosed herein may be combined for additional advantage.

Other aspects, features and embodiments of the invention will be more fully apparent from the ensuing disclosure and appended claims.

DETAILED DESCRIPTION

Figure 1:
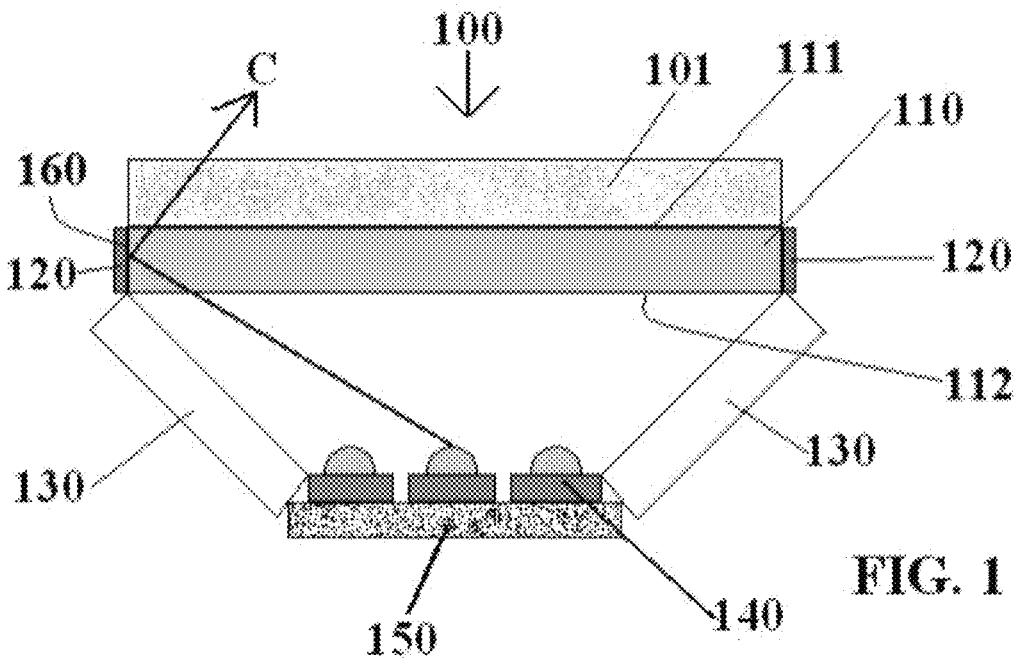
FIG. 1 is a schematic side cross-sectional view of a lighting device including an optical element bounded by a reflective ring of material, according to one embodiment of the present invention.

The present invention now will be described more fully hereinafter with reference to the accompanying drawings, in which embodiments of the invention are shown. The present invention may, however, be embodied in many different forms and should not be construed as limited to the specific embodiments set forth herein. Rather, these embodiments are provided to convey the scope of the invention to those skilled in the art. In the figures, the size and relative sizes of layers and regions may be exaggerated for clarity.

Unless otherwise defined, terms (including technical and scientific terms) used herein should be construed to have the same meaning as commonly understood by one of ordinary skill in the art to which this invention belongs. It will be further understood that terms used herein should be interpreted as having a meaning that is consistent with their meaning in the context of this specification and the relevant art, and should not be interpreted in an idealized or overly formal sense unless expressly so defined herein.

Unless the absence of one or more elements is specifically recited, the terms "comprising," "including," and "having" as used herein should be interpreted as open-ended terms that do not preclude the presence of one or more elements.

The terms "electrically activated emitter" and "emitter" as used herein refers to any device capable of producing visible or near visible (e.g., from infrared to ultraviolet) wavelength radiation, including but not limited to, xenon lamps, mercury lamps, sodium lamps, incandescent lamps, and solid state emitters—including diodes (LEDs), organic light emitting diodes (OLEDs), and lasers. Certain emitters as contemplated herein output emissions with peak wavelength in the visible range. Various types of electrically activated emitters generate steady state thermal loads upon application thereto of an operating current and voltage. In the case of solid state emitters, such steady state thermal load, operating current and voltage are understood to correspond to operation of the solid state emitter at a level that maximizes emissive output at an appropriately long operating life (preferably at least about 5000 hours, more preferably at least about 10,000 hours, more preferably still at least about 20,000 hours).

Various embodiments include lumiphoric materials that are spatially segregated from one or more electrically activated emitters. In certain embodiments, such spatial segregation may involve separation of a distance of preferably at least about 1 mm, more preferably at least about 2 mm, more preferably at least about 5 mm, and more preferably at least about 10 mm. In certain embodiments, conductive thermal communication between a spatially segregated lumiphoric material and one or more electrically activated emitters is not substantial.

Electrically activated emitters may be used individually or in combination with one or more lumiphoric materials (e.g., phosphors, scintillators, lumiphoric inks) and/or optical elements to generate light at a peak wavelength, or of at least one desired perceived color (including combinations of colors that may be perceived as white). Inclusion of lumiphoric (also called 'luminescent') materials in emitters may be accomplished by adding such materials to encapsulants, adding such materials to lenses, or by direct coating onto the emitters. As mentioned above, direct coating of lumiphoric materials onto emitters creates a number of problems including degradation and darkening of the binding medium used to secure the lumiphoric material to the LED. Other materials, such as dispersers and/or index matching materials, may be included in such encapsulants.

The terms "optical element," "optical filter," or "optical reflector" as used herein refers to any acceptable filter, reflector, or combination thereof used to reflect or filter selected wavelengths of light that may otherwise (i.e., in the absence of such element) be exposed to or emitted from the emitter or lumiphoric material. Optical reflectors may include interference reflectors, and further include dichroic mirrors that reflect certain wavelengths while allowing others to pass through. Optical filters include interference filters, and further include dichroic filters that restrict or block certain wavelengths while allowing others to pass through. Optical reflectors may be used to prevent a substantial amount of light converted by a lumiphoric material from being incident on the electrically activated emitter. In one embodiment, an optical element may comprise a glass disc having a filter or mirror (e.g., dichroic filter or dichroic mirror) on one face and optionally an anti-reflective coating on the other.

Many optical elements such as dichroic mirrors, however, are not ideal and can leak a large percentage of the emitted light, particularly when not bound in an enclosed structure. There is a tradeoff between the loss of approximately 8-20% incurred by an optical element (e.g., dichroic filter) and the approximately 15-30% gain associated with yellow light generated by a lumiphoric material (e.g., phosphor) not being reabsorbed into an emitter. This tradeoff directly correlates to the ratio of reflective area in the back chamber to the absorptive area (e.g., chips and packages) in the back chamber. Additionally, most of the light leakage occurs through the edge of the disc or other support element (e.g., glass) supporting the filter.

Figure 2:
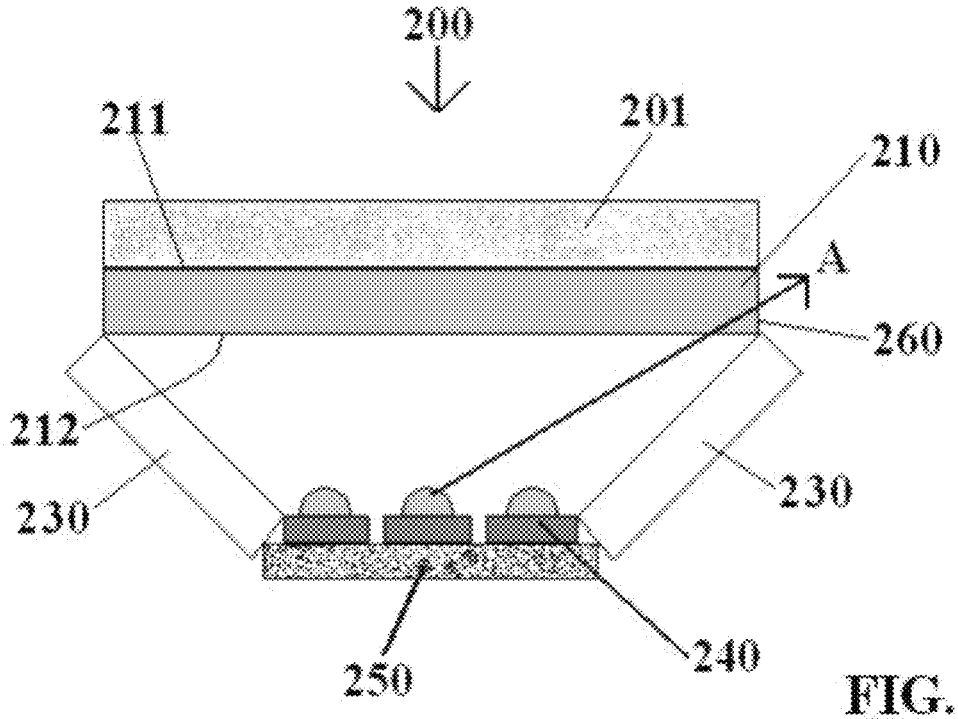
FIG. 2 is a schematic side cross-sectional view of a comparative example lighting device including an optical element without a reflective ring of material, depicting a loss of light through an edge of the optical element.

FIG. 2 provides a cross-sectional schematic view of a lighting device 200 according to a comparative example used to measure loss of light 2. One or more electrically activated emitters 240 may be supported by a base and/or heat sink 250 and disposed within or proximate to a reflector cup including angled walls 230 extending upward from the base 250. An optical element 210 (e.g., such as may be used to reflect or filter selected wavelengths of light) may be arranged between a lumiphoric material 201 (e.g., a phosphor) and the electrically activated emitter 240. In one particular device according to the preceding design, it was observed that an appreciable amount of light produced from the emitter (e.g., blue LED) was lost, out of a peripheral edge of the optical element and as a result of total internal reflectivity ("TIR") within the structure. Since light emitted by the LED never reached the lumiphoric material 201 through the optical element 210, the output was observed as being more blue than desired, as a result of direct emission of blue light without passage through the lumiphoric material 201. An illustrative beam 'A' depicted in FIG. 2 illustrates (undesirable) escape of light emanating from an electrically activated emitter 240 through an edge 260 of the optical element 210. In another comparative example, the lumiphoric material was replaced with a piece of heavy black felt, and resulted in a 3% loss of blue light due to TIR and peripheral edge transmission. This indicates that up to 3% of the light emanating from the electrically activated emitter (blue LED) 240 escaped from the device 200 without interacting with the lumiphoric material 201, predominantly by transmission through a peripheral edge 260 of the optical element 210.

Various embodiments of the present invention provide advantages associated with use of spatially segregated or remote lumiphoric materials (e.g., to minimize thermal degradation of lumiphors), and further limit total internal reflectivity and loss of light that tend to reduce emissions and/or affect perception of output color. In one embodiment, an optical element is arranged between an electrically activated emitter and a lumiphoric material, wherein the optical element includes a reflective material arranged proximate to one or more peripheral edges to prevent converted light (e.g., most or substantially all converted light) from leaking from a side of the optical element or from reflecting back on the electrically activated emitter. In one embodiment, an optical element is bounded by at least one peripheral edge, and a reflective material is disposed substantially parallel to (or on) the at least one peripheral edge. In one embodiment, an optical element is adapted to receive at least a portion of emissions from at least one electrically activated emitter, and includes at least one peripheral edge, wherein a reflective material is disposed substantially parallel to the at least one peripheral edge. The at least one peripheral edge is distinguished from a major surface (e.g., face) of the optical element, with the at least one peripheral edge being non-coplanar with, and arranged to bound, such a major surface.

The term "reflective material" as used herein refers to any acceptable reflective material in the art, including (but not limited to) particular MCPET (foamed white polyethylene terephthalate), and surfaces metalized with one or more metals such as (but not limited to) silver (e.g., a silvered surface). MCPET manufactured by Otsuka Chemical Co. Ltd. (Osaka, Japan) is a diffuse white reflector that has a total reflectivity of 99% or more, a diffuse reflectivity of 96% or more, and a shape holding temperature of at least about 160° C. A preferred reflective material would be at least about 90% reflective, more preferably at least about 95% reflective, and still more preferably at least about 98-99% reflective of light of a reflective wavelength range, such as one or more of visible light, ultraviolet light, and/or infrared light, or subsets thereof.

The term "substantially parallel" as used herein, such as with reference to a reflective material being disposed substantially parallel to at least one peripheral edge, refers to an angle differing from a primary surface of the peripheral edge by preferably less than 45 degrees, more preferably less than about 30 degrees, still more preferably less than about 15 degrees, still more preferably less than about 10 degrees, still more preferably less than about 5 degrees, still more preferably less than about 2 degrees; or otherwise arranged to reflect light toward a lumiphoric material.

The term "peripheral edge" as used herein, such as with reference to an optical element having at least one peripheral edge, refers to any peripheral portion of a material such as an optical element that may be exposed to or face an exterior of a lighting structure and providing potential for escape of light. In various embodiments, an optical element may be bounded by at least one peripheral edge, wherein a reflective material is disposed proximate to, disposed substantially parallel to, and/or contacting substantially the entirety of at least one peripheral edge.

Various embodiments disclosed herein relate generally to lighting devices comprising optical elements that are bounded along at least one peripheral edge thereof by reflective material and/or include at least one peripheral edge that is non-perpendicular to a face of the optical element and arranged to reflect light in a direction toward a lumiphoric material, whereby the total internal reflectivity and loss of light through the optical elements are minimized or otherwise reduced. In one preferred embodiment, a lumiphoric material is spatially segregated from at least one electrically activated emitter and includes an optical element arranged between the emitter(s) and lumiphoric material, wherein the optical element includes a reflective material disposed proximate to at least one peripheral edge thereof.

In one embodiment, an optical element is adapted to receive at least a portion of emissions from an electrically activated emitter, and includes at least one peripheral edge, wherein a reflective material is disposed substantially parallel to the at least one peripheral edge. In particular, reflective redirection of emissions proximate to the peripheral edge of the optical element is sought to minimize the loss of emissions due to TIR and edge transmission. Ideally, reflective redirection of emissions is toward the lumiphoric material so that at least a portion of emissions from an electrically activated emitter having a first peak wavelength may be absorbed by the lumiphoric material and re-emitted (e.g., upconverted) at a second peak wavelength that differs from the first peak wavelength.

In one embodiment, the peripheral edge of an optical element may be angled toward the lumiphoric material with reflective material disposed proximate to the edge, such that the peripheral edge is non-perpendicular to a face of the optical element. Providing a peripheral edge that is non-perpendicular to a face of the optical element may prevent directing reflected the light back toward an opposing edge of the optical element; and instead desirably direct reflected light toward a lumiphoric material.

In one embodiment, an optical element for use with a lighting device including at least one lumiphoric material (and a lighting device including such optical element) includes reflective material is disposed substantially parallel to at least one peripheral edge of the optical element, wherein the at least one peripheral edge is also non-perpendicular to a face of the optical element and arranged to reflect light in a direction toward the at least one lumiphoric material.

In one embodiment, at least one lumiphoric material is supported in or on an optical element for use with a lighting device and as described herein.

Advantages and features of the invention are further illustrated with reference to the following examples and figures, which are not to be construed as limiting the scope of the invention but rather as illustrative of various embodiments of the invention in specific application thereof.

FIG. 1 illustrates a lighting device 100 including one or more electrically activated emitters 140 (e.g., LEDs) according to one embodiment of the present invention. The electrically activated emitter(s) 140 may be supported by a base 150 (optionally consisting of or including a heat sink) and may be surrounded on sides thereof by an angled (e.g., conical) wall 130 extending from an area proximate to the base 150 upwards at an angle toward a distal point opposite the base, wherein the wall 130 has an opening of greater diameter distal from the base than a portion of the wall 130 proximate to the base 150. The wall 130 may include a reflector (e.g., diffuse white reflector) material to reflect light emanating from the electrically activated emitter(s) 140 toward an optical element 110. The optical element 110 may include any one of an optical filter or an optical reflector on one surface or face 112 (e.g., proximate to the electrically activated emitters 140), and may including any one of an optical filter or an optical reflector on the opposing surface or face 111 (e.g., distal from the emitter(s) 140). The optical element 110 may include an anti-reflective coating on one or both faces 111 and 112. The optical element 110 is disposed between the electrically activated emitter(s) 140 and a lumiphoric material 101 (e.g., phosphor), and has associated therewith a reflective material 120 proximate to at least one peripheral edge 160 (and preferably all peripheral edges) thereof to contain and reflect light emanating from the electrically activated emitter(s) 140 and redirect the reflected light toward the lumiphoric material 101.

In one embodiment, the lumiphoric material 101 is spatially segregated from the electrically activated emitter 140, with the optical element 110 disposed between the electrically activated emitter 140 and the lumiphoric material 101. For instance, the optical element 110 may be disposed proximate to or directly on the electrically activated emitter 140. The lumiphoric material 101 may be disposed proximate to or on the optical element 110, with the optical element 110 being disposed between the optical element 110 and the electrically activated emitter(s) 140. Light emanating from the electrically activated emitter(s) 140 toward a peripheral edge 160 of the optical element 110 is redirected by the reflective material 120 (e.g., shaped a reflective ring around the optical element 110) toward the lumiphoric material 101, such as along beam path "C." The reflective material 120 may be a highly reflective white material (e.g., MCPET) arranged adjacent to or (more preferably) on an outside edge of the optical element 110. Measurements taken from a device according to the design of FIG. 1 reveal that approximately 95% of all blue light emanating from a blue light LED may be recovered and directed toward the top face 111 of the optical element 110 to impinge on the lumiphoric material 101. The reflective material 120 is disposed substantially parallel to the at least one peripheral edge 160 of the optical element 120 and therefore arranged to reflect at least a substantial portion of light received from the emitter(s) 140 in a direction toward the lumiphoric material 101.

In the embodiment shown in FIG. 1 the peripheral wall 160 is arranged substantially perpendicular to at least one face 111, 112 of the optical element 110, such that light propagating laterally within the optical element 110 could be redirected by the reflective material 120 internal to the optical element 100 (i.e., toward an opposing edge or edge portion of the optical element 110). Therefore, rather than providing a peripheral edge 160 disposed perpendicular to at least one face 111, 112 of the optical element 110 such as shown in FIG. 1, it may be preferable to provide a peripheral edge arranged non-perpendicular to at least one face of an optical element, such as depicted in FIGS. 3 and 4.

Figure 3:
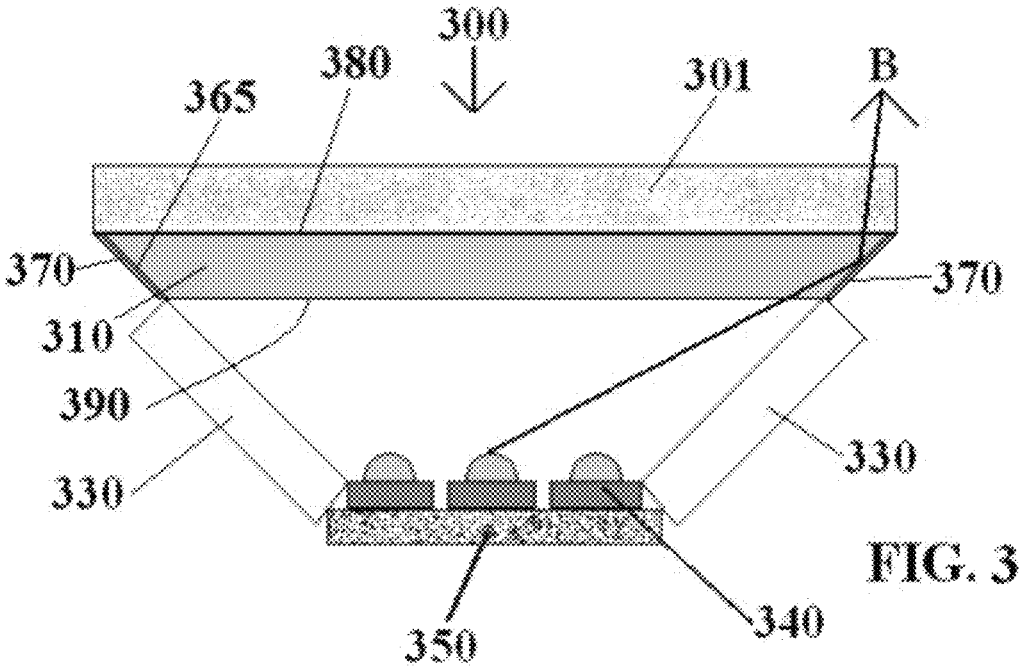
FIG. 3 is a schematic side cross-sectional view of a lighting device including an optical element having angled edges coated with a reflective material, according to another embodiment of the present invention.

FIG. 3 illustrates a lighting device 300 according to another embodiment, wherein the optical element 310 includes at least one angled peripheral edge 365 with a reflective material 370 arranged proximate to the edge 365, parallel to the edge 365, and/or coated on the edge 365, to redirect light originally directed toward edges 365 of the optical element 310 in a direction toward the lumiphoric material 301. Use of a reflective material 370 may not be necessary if the angle of the peripheral edge(s) 365 is sufficiently great enough to prevent transmission of light otherwise directed toward the edge 365 and/or if the lumiphoric material 301 matches the exterior surface area 380 of the optical element 310. Use of a reflective material 370, however, may preclude a need for extending the lateral dimensions of the optical element 310 and lumiphoric material 301 to accommodate various different angled arrangements of the peripheral edge 365 and various possible relative arrangements between the optical element 310 and the lumiphoric material 301. As with the lighting devices 100 and 200 in FIGS. 1 and 2, respectively, the embodiment represented in FIG. 3 likewise includes at least one electrically activated emitter 340 that may be supported by a base 350 and surrounded on the sides by an angled (e.g., conical wall 330) extending upward from the base 350 (or area proximate to the base 350) with an increasing cross-sectional width or diameter. The wall 330 may include a reflector (e.g., diffuse white reflector) material to contain and reflect light emanating from the electrically activated emitter 340 toward an optical element 310. The optical element 310 may include any one of an optical filter or optical reflector on a first surface or face 380 thereof, and may include any one of an optical filter or optical reflector on a second surface or face 390. The optical element 310 may include an anti-reflective coating on one or both faces 380 and 390. The optical element 310 is preferably disposed between the electrically activated emitter(s) 340 and a lumiphoric material 301. A lumiphoric material 301 (e.g., phosphor) is spatially segregated from the electrically activated emitter 340, and may be disposed on or above an outer face 380 of the optical element 310 distal from the electrically activated emitter(s) 340. Light emanating from the electrically activated emitter(s) 340 toward a peripheral edge 365 of the optical element 310, and/or light propagating within the optical element 310, is redirected by the reflective angled edge 370 toward the lumiphoric material 301, such as along the illustrated beam path "B." The reflective angled edge 370 may have a surface metalized with silver and angled to reduce light being redirected internal to the optical element 310, further reducing the loss of light and total internal reflection.

Figure 4:
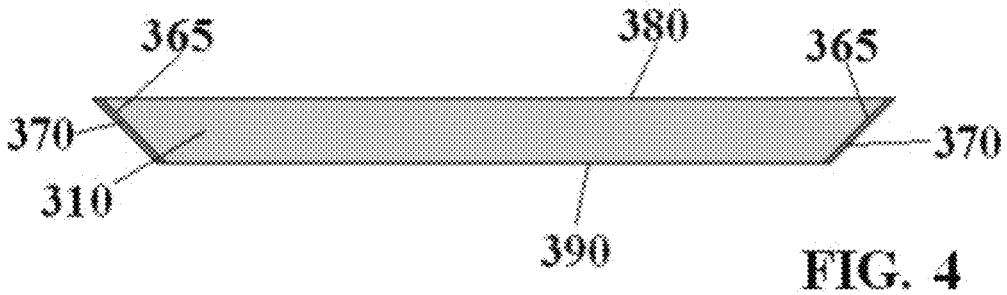
FIG. 4 is a schematic side cross-sectional view of an optical element having angled edges coated with a reflective material, similar to the embodiment in FIG. 3.

FIG. 4 illustrates the optical element 310 apart from other elements of the lighting device 300 shown in FIG. 3. Referring to FIG. 4, the optical element 310 has a first narrower face 390 that may include any one of an optical filter or optical reflector, and a second wider face 380 that may include any one of an optical filter or optical reflector. At least a portion of (and preferably the entirety of) a peripheral edge 365 bounding the first (e.g., inner) face 390 and the second face 380 is angled to promote reflection of light through the second (e.g., outer) face 380 toward a lumiphoric material (not shown). The angled edge 365 has an associated reflective material 370 arranged proximate to the edge 365, parallel to the edge 365, and/or coated on the edge 365, to redirect light through the second face 380. The reflective material 370 may conform in shape to the peripheral edge 465. Although the peripheral edge 365 and reflective material 370 are illustrated as being substantially straight, one or both of the peripheral edge 365 and reflective material 370 may be curved or a compound shape such as may include segments of different angles. In one embodiment, the second (e.g., outer) face 380 may be proximate to a lumiphoric material. Either face or both faces 380, 390 may include an anti-reflective coating.

In one embodiment, an optical element (e.g., internally and/or along either face or both faces) as described herein may be ridged, textured, coated, or otherwise fabricated to provide light scattering and/or light diffusing utility, such as may be particularly desirable if utilized in conjunction with multiple different electrically activated solid state emitters.

Lighting devices according to various embodiments may include optical elements having curved or other substantially non-planar shapes.

Figure 5:
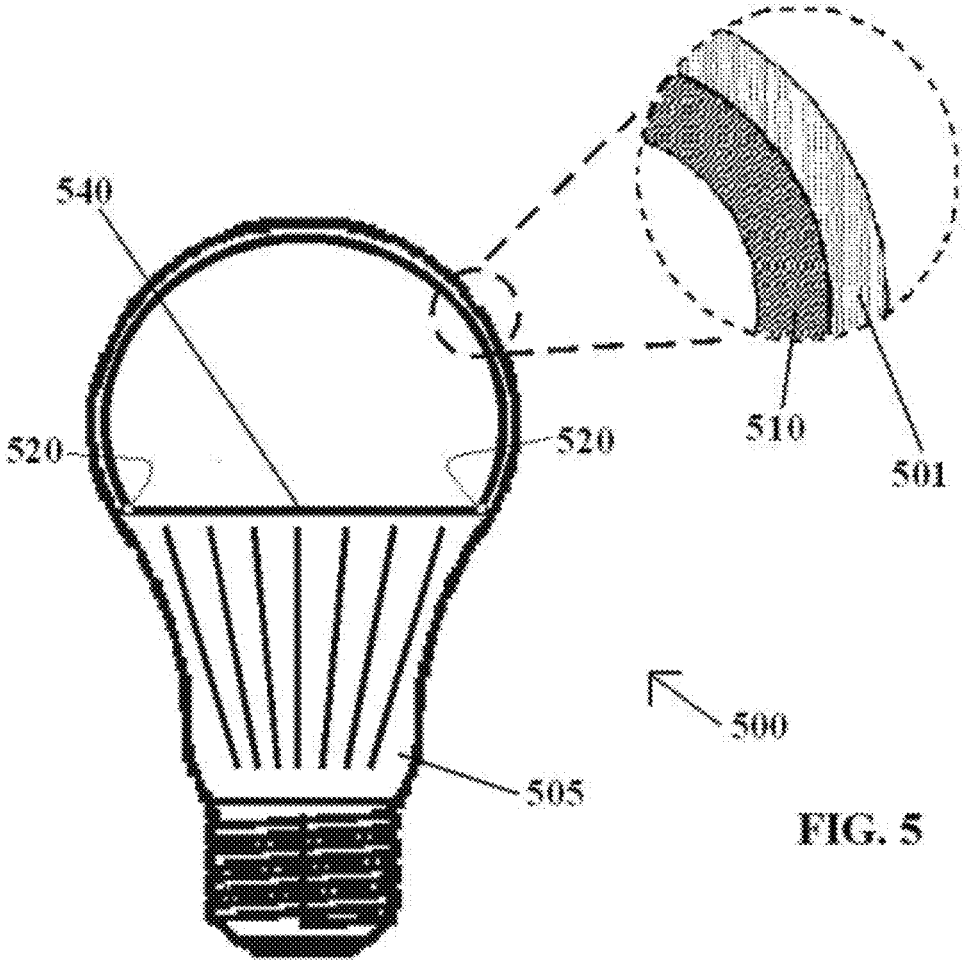
FIG. 5 is a schematic side view of a lighting device together with a magnified cross-sectional view of a portion thereof, including an optical element arranged between an electrically activated emitter and a lumiphoric material, according to another embodiment of the present invention.

FIG. 5 depicts a lighting device (e.g., light bulb) 500 including a magnified view of a portion thereof, with an optical element 510 arranged between an electrically activated emitter region 540 and a lumiphoric material 501, according to one embodiment of the present invention. The lumiphoric material 501 may be dispersed in or coated on an appropriate substrate material, which may further provide light mixing, scattering, and/or diffusion utility. In this embodiment or any other embodiment described herein, an optional scattering or diffusing structure or layer (not shown) may be provided separately from a lumiphoric material layer, with a lumiphoric material layer arranged between an at least one electrically activated emitter and the foregoing scattering or diffusing structure or layer. FIG. 5 depicts a reflective material 520 disposed proximate to peripheral (e.g., lower) edges of the optical element 510. The lighting device 500 also includes a heat sink 505 along an external surface thereof and arranged to dissipate heat generated by the lighting device 500 to an ambient environment. The heat sink 505 may include a plurality of fins and is preferably in conductive thermal communication with one or more electrically activated emitters within the lighting device 500.

Figure 6:
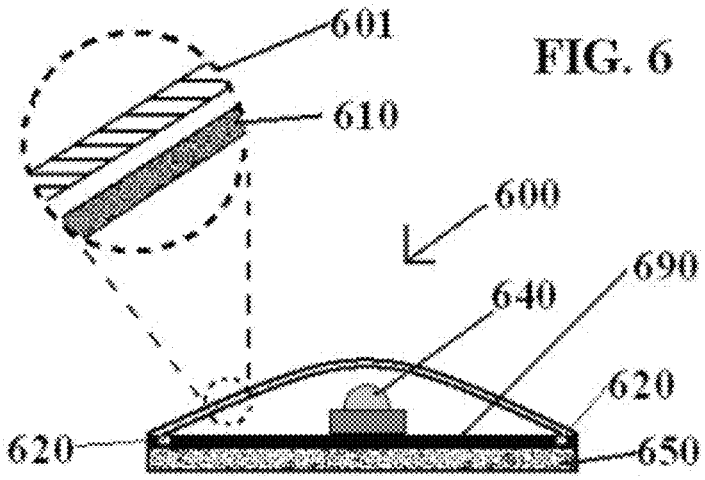
FIG. 6 is a schematic side cross-sectional view of a lighting device together with a magnified cross-sectional view of a portion thereof, including an optical element arranged between an electrically activated emitter and a lumiphoric material, according to another embodiment of the present invention.

FIG. 6 depicts a lighting structure 600 including a hemispherical shaped optical element 610 disposed between a lumiphoric material 601 (also hemispherical shaped) and an electrically activated emitter 640, according to one embodiment of the present invention. A reflective material 620 is disposed proximate to (or on) the peripheral edges of the optical element 610 and arranged to reflect light in a direction toward the lumiphoric material 601. A reflective floor 690 may also be present on or above a base 650 (e.g., embodying a submount and/or heat sink) supporting the electrically activated emitter 640.

One embodiment of the present invention includes a light fixture including at least one lighting structure as disclosed herein. In one embodiment, a light fixture includes a plurality of lighting devices as disclosed herein. In one embodiment, a light fixture is arranged for recessed mounting in ceiling, wall, or other surface. In one embodiment, a light fixture is arranged for track mounting. A lighting device may be may be permanently mounted to a structure or vehicle, or constitute a manually portable device such as a flashlight.

In one embodiment, an enclosure comprises an enclosed space and at least one lighting structure or light fixture including such structure as disclosed herein, wherein upon supply of current to a power line, the at least one lighting device illuminates at least one portion of the enclosed space. In another embodiment, a structure comprises a surface or object and at least one lighting device as disclosed herein, wherein upon supply of current to a power line, the lighting device illuminates at least one portion of the surface or object. In another embodiment, a lighting device as disclosed herein may be used to illuminate an area comprising at least one of the following: a swimming pool, a room, a warehouse, an indicator, a road, a vehicle, a road sign, a billboard, a ship, a toy, an electronic device, a household or industrial appliance, a boat, and aircraft, a stadium, a tree, a window, a yard, and a lamppost.

While the invention has been has been described herein in reference to specific aspects, features and illustrative embodiments of the invention, it will be appreciated that the utility of the invention is not thus limited, but rather extends to and encompasses numerous other variations, modifications and alternative embodiments, as will suggest themselves to those of ordinary skill in the field of the present invention, based on the disclosure herein. Any features disclosed herein are intended to be combinable with other features disclosed herein unless otherwise indicated. Correspondingly, the invention as hereinafter claimed is intended to be broadly construed and interpreted, as including all such variations, modifications and alternative embodiments, within its spirit and scope.

What is claimed is:

1. A lighting device comprising:

at least one electrically activated emitter;

at least one lumiphoric material spatially segregated from the at least one electrically activated emitter, and arranged to receive at least a portion of emissions from the at least one electrically activated emitter; and a reflector cup arranged to reflect at least a portion of emissions from the at least one electrically activated emitter toward the at least one lumiphoric material;

an optical element, selected from the group consisting of optical filters and interference reflectors, arranged between the at least one electrically activated emitter and the at least one lumiphoric material, and arranged to enclose the reflector cup, wherein the optical element includes a first face, a second face, and at least one peripheral edge arranged to bound the first face and the second face;

wherein the at least one peripheral edge of the optical element is non-perpendicular to a face of the optical element and arranged to reflect light in a direction toward the at least one lumiphoric material.

2. The lighting device of claim 1, wherein the reflective material is disposed substantially parallel to the at least one peripheral edge.

3. The lighting device of claim 2, wherein the reflective material is at least about 90% reflective of a peak wavelength emitted by the at least one electrically activated emitter.

4. The lighting device of claim 2, wherein the reflective material is disposed substantially parallel to the at least one peripheral edge.

5. The lighting device of claim 2, wherein the reflective material contacts substantially the entirety of the at least one peripheral edge.

6. The lighting device of claim 2, wherein the reflective material comprises a diffuse white reflector.

7. The lighting device of claim 2, wherein the reflective material comprises a metalized reflector.

8. The lighting device of claim 1, wherein the at least one electrically activated emitter is adapted to output emissions with a peak wavelength in the visible range.

9. The lighting device of claim 1, wherein the optical element comprises an anti-reflective surface and a dichroic filter or dichroic mirror surface.

10. The lighting device of claim 1, wherein the at least one electrically activated emitter comprises a light emitting diode.

11. The lighting device of claim 1, wherein the at least one lumiphoric material comprises a phosphor.

12. The lighting device of claim 1, wherein the optical element comprises an interference filter.

13. The lighting device of claim 12, wherein the interference filter is adapted to pass a selected range of one or more wavelengths while disallowing passage of other wavelengths.

14. The lighting device of claim 13, wherein the interference filter comprises a dichroic filter.

15. The lighting device of claim 1, wherein the optical element comprises an interference reflector.

16. The lighting device of claim 15, wherein the interference reflector comprises a dichroic mirror.

17. The lighting device of claim 1, wherein the at least one emitter is adapted to output emissions comprising a first peak wavelength, and the at least one lumiphoric material is adapted to re-emit lumiphor emissions comprising a second peak wavelength that that differs from the first peak wavelength.

18. The lighting device of claim 1, wherein the at least one lumiphoric material comprises an inner face, an outer face, a thickness that is generally perpendicular to the inner face and the outer face, and a width dimension that is substantially constant for all thickness values between the inner face and the second face.

19. An optical element for use with a lighting device including at least one lumiphoric material, the optical element embodying an interference reflector, wherein the interference reflector includes a first face, a second face, and at least one peripheral edge arranged to bound the first face and the second face, and wherein the at least one peripheral edge is non-perpendicular to a face of the interference reflector and arranged to reflect light in a direction toward the at least one lumiphoric material.

20. The optical element of claim 19, wherein a reflective material is disposed substantially parallel to the at least one peripheral edge.

21. The optical element of claim 20, wherein the reflective material is at least about 90% reflective of a peak wavelength emitted by the at least one electrically activated emitter.

22. The optical element of claim 20, wherein the reflective material is coated on the at least one peripheral edge.

23. The optical element of claim 20, wherein the reflective material contacts substantially the entirety of the at least one peripheral edge.

24. The optical element of claim 20, wherein the reflective material comprises a diffuse white reflector.

25. The optical element of claim 20, wherein the reflective material comprises a metalized reflector.

26. The optical element of claim 19, wherein the at least one lumiphoric material is supported in or on the optical element.

27. The optical element of claim 19, wherein the at least one lumiphoric material comprises a phosphor.

28. The optical element of claim 19, wherein the interference reflector comprises a dichroic mirror.

* * * * *